US005178086A

United States Patent [19]

Ross

[11] Patent Number: 5,178,086

[45] Date of Patent: Jan. 12, 1993

[54] HIGH PERFORMANCE SAIL CONSTRUCTION

[76] Inventor: Thomas D. Ross, P.O. Box 383567, Waikoloa, Hi. 96738

[21] Appl. No.: 729,609

[22] Filed: Jul. 15, 1991

[51] Int. Cl.[5] ..... B63H 9/06

[52] U.S. Cl. ..... 114/102; 114/103

[58] Field of Search ..... 114/102, 103, 39.1, 114/39.2, 90, 91, 105, 106

[56] References Cited

U.S. PATENT DOCUMENTS

| | | | |
|---|---|---|---|
| 3,581,698 | 6/1971 | Bete | 114/102 |
| 4,699,073 | 10/1987 | Farneti | 114/103 |
| 4,708,079 | 11/1987 | Magnan | 114/103 |
| 4,733,624 | 3/1988 | Belvedere | 114/103 |
| 4,766,831 | 8/1988 | Johnston | 114/103 |
| 4,834,013 | 5/1989 | Smart | 114/90 |
| 4,856,447 | 8/1989 | Magnan | 114/102 |
| 4,864,953 | 9/1989 | Allsopp et al. | 114/103 |
| 4,924,794 | 5/1990 | Duke | 114/103 |
| 5,038,699 | 8/1991 | Cochran et al. | 114/103 |

*Primary Examiner*—Jesûs D. Sotelo

*Assistant Examiner*—Stephen P. Avila

*Attorney, Agent, or Firm*—Jack N. McCarthy

[57] ABSTRACT

High performance sail craft operate in high apparent wind velocities which induce high aerodynamic loads into the said surface. This invention provides a light weight sail construction that resists deformation of the sail surface caused by high aerodynamic loads. The sail construction consists mainly of ribs permanently affixed to the sail surface to stretch the sail material. Each rib in the sail provides the required amount of stretch in the sail material to eliminate stretch folds in the sail surface. Each rib in the sail has the stiffness or resistance to flexure varying along its length to control the sail surface curvature thereby providing a low drag airfoil for high speed sailing. A double surface sail construction is provided wherein each sail surface consists of the aforemention sail construction. A parabolic nose forms the leading edge of the double surface sail to provide smooth air flow entry. The rearward end of each sail surface is joined to form the sail trailing edge. Water drain passages are provided at the trailing and foot of the double surface sail.

26 Claims, 10 Drawing Sheets

HIGH PERFORMANCE SAIL CONSTRUCTION

DESCRIPTION

1. Technical Field

This invention relates to sail construction for sail craft used in the air, on ice, land, and water, and particularly to an improved construction for use on high performance kites and hang gliders and particularly wind surfing sail craft which operate at high sail craft speeds which induce large aerodynamic loads into the sail structure.

2. Background Art

A high performance sail design depends on the planform shape and the camber distribution or three-dimensional shape of the sail. The aerodynamic flow over the sail surface will provide the greatest driving force if the designed shape of the sail is maintained for the true wind speeds the sail is intended to operate in. This shape relies mainly on the relationship of the mast and rib structure and the sail material.

The sail structure, when rigged, has internal static forces that cause uneven stretching of the sail material. The magnitude of the internal static forces depend on the stiffness of the mast, its length, and the amount of mast curvature desired in the sail design and also the stiffness distribution of each batten that is used in the sail structure. The greater the internal forces used in the sail structure, the more the sail material is unevenly stretched. This uneven stretching causes stretch folds, or wrinkles, in the sail surface. Because the wrinkles cause deviation of the intended design sail shape and disturbances of the aerodynamic flow near the sail surface, the overall performance of the sail is reduced.

A previous means of pre-stretching the sail material with ribs during the initial fabrication of the sail has not been provided. In the past, the sailor installed battens in the sail and then stretched the sail material with a system of batten buckles and webbing straps during the rigging of his sail at the beach. In the old method, the proper amount of stretching of the sail material cannot be assured because the batten-buckle systems used are unable to provide or maintain the high tension forces required to minimize stretch folds in the material used in a high performance sail structure. The high tension forces are caused by the static forces resulting from rigging the sail and the aerodynamic forces in the sail caused by high speed sailing.

Typically, high performance sails have higher aspect ratios. The aspect ratio is defined as the span or height of the sail squared divided by its area. As the aspect ratio goes up in the sail, the sail appears to become more slender. The static rigging forces induced by the flexure resistance of the mast when flexed for a particular luff curve, increases as the aspect ratio of the sail increases. The primary paths of static tension forces in the sail are in the regions between the sail tack and sail clew, sail clew and sail head, and between the sail tack and sail head. As the static tension forces in these regions increase, the stretch folds in the sail material will also increase. The precise or controlled amount of rib tensioning required to eliminate or minimize stretch folds in the sail material used in a high performance sail has not been provided in the past. Previous batten tension means have been heavy and required a large amount of rigging time and de-rigging time that is not appreciated by all sailors because it takes away from the time available to sail.

In the prior methods of sail construction, the batten pockets with buckle and tension webbing add undesirable weight to to the sail structure and are incapable of providing the tension forces required in a high performance sail because of lack of mechanical leverage in the batten buckle-webbing systems.

Patents that set forth sail structures are U.S. Pat. Nos. 3,487,800; 4,335,669; 4,625,671; and 4,699,073.

DISCLOSURE OF INVENTION

This invention relates to a sail structure and more particularly to a construction method that provides pre-stretching of the sail material by permanently fixed ribs to assure the intended design shape or sail section curvature and sail surface smoothness.

The present invention utlizes the physical properties data provided by the sail material manufacturer and the tension force data derived from flexure test of the mast and each rib that is to be used in the sail design and also the aerodynamic load distribution data which is derived by aerodynamic analysis of the sail design. The aerodynamic analysis includes such basic variable input data as (1) true wind velocity; (2) course sailed in relation to true wind; (3) desired sail board speed; (4) true wind gradient; (5) sail shape and area; and (6) sail camber distribution. The tension force data provides the average stress distribution in the sail in the region between the sail tack and sail clew, sail clew and head, and sail tack and sail head. The stress-strain data of the polyester film sail material is utilized to be assured that the pre-stretched rib induced stress levels in the sail are within the elastic limits of the material used. Without the required pre-stretch rib induced tension force in the sail, the combined aerodynamic and static rigging loads will cause stretch folds in the sail surface causing deviation in the sail surface smoothness and shape and thereby a reduction in the performance level of the sail. The preferred sail material used in this invention is Mylar®; however, other clear polyester film material, or materials having similar physical properties as Mylar®, may also be used.

It is an object of this invention to provide ribs permanently affixed to the sail surface to stretch the sail material to assure that the intended designed shape of the sail will be maintained for the desired high performance level required in the sail craft. High performance sails operate in high apparent wind velocities that cause high tension loads in the sail material.

Another object of this invention is to provide, after a design shape of the sail has been determined, along with the length and location of the ribs, a method of affixing the ribs permanently while providing pre-stretch loads in the sail.

A further object of the invention is to affix a rib in place between the leading edge and the trailing edge of a sail when the rib is longer than that length, using the method of (1) fixing one end of the rib to the leading edge of the sail; (2) bending the rib to place the other end of the rib at the trailing edge of the sail; (3) fixing the other end of the rib to the trailing edge of the sail; (4) placing an adhesive between the rib and sail; (5) pressing said rib against said sail to stretch the sail and permanently adhere the rib to the sail.

It is another object of the invention to apply a front rivet plate assembly adjacent the leading edge and a rear rivet plate assembly adjacent the trailing edge to hold the ends of the rib under compression.

It is another object of this invention to provide an improvement in a commercially available batten to be used as a rib in this invention. The width of said batten is made narrow near its front portion in a manner described herein to adjust its curvature and its position to improve the airfoil shape of the sail surface.

It is another object of this invention to provide an improvement in a commercially available batten to be used as a rib in this invention. Epoxy glass or carbon fiber strips are laminated to the mid portion of said batten in a manner described herein to adjust its curvature and simultaneously increase its stiffness to improve the airfoil shape of the sail surface.

It is another object of this invention to provide an improvement in a commercially available batten to be used as a rib in this invention. The width of said batten is made narrow near its front portion in a manner described herein to adjust its forward curvature. Epoxy glass or carbon fiber strips are laminated to the mid portion of said batten in a manner described herein to adjust its mid section curvature and simultaneously its stiffness to improve the airfoil shape of the sail surface.

It is another object of this invention to provide an improvement in a commercially available batten to be used as a rib in this invention. Permanently fixed tip extenders and a connecting flexible member is fixed to the front portion of said batten in a manner described herein to adjust its curvature and position to improve the airfoil shape of the sail surface.

It is another object of this invention to secure a front rivet plate assembly adjacent the leading edge to the sail material and a rear rivet plate assembly adjacent the trailing edge to the sail material.

It is another object of this invention to provide a further improvement in sail performance by providing a double surface sail construction wherein each sail surface consists of the sail construction described in the before stated objectives.

It is another object of this invention to provide a further improvement in a double surface sail construction by providing a parabolic nose along the leading edge portion of the sail assembly. The parabolic nose consists of an upper flexible section fixed to the mast and a lower flexible section fixed to the mast.

BRIEF DESCRIPTION OF THE DRAWINGS

This invention consists of a sail structure which will be best understood by referring to the following detailed description of the invention and drawings referred to therein.

BEST MODE FOR CARRYING OUT THE INVENTION

Figure 1:
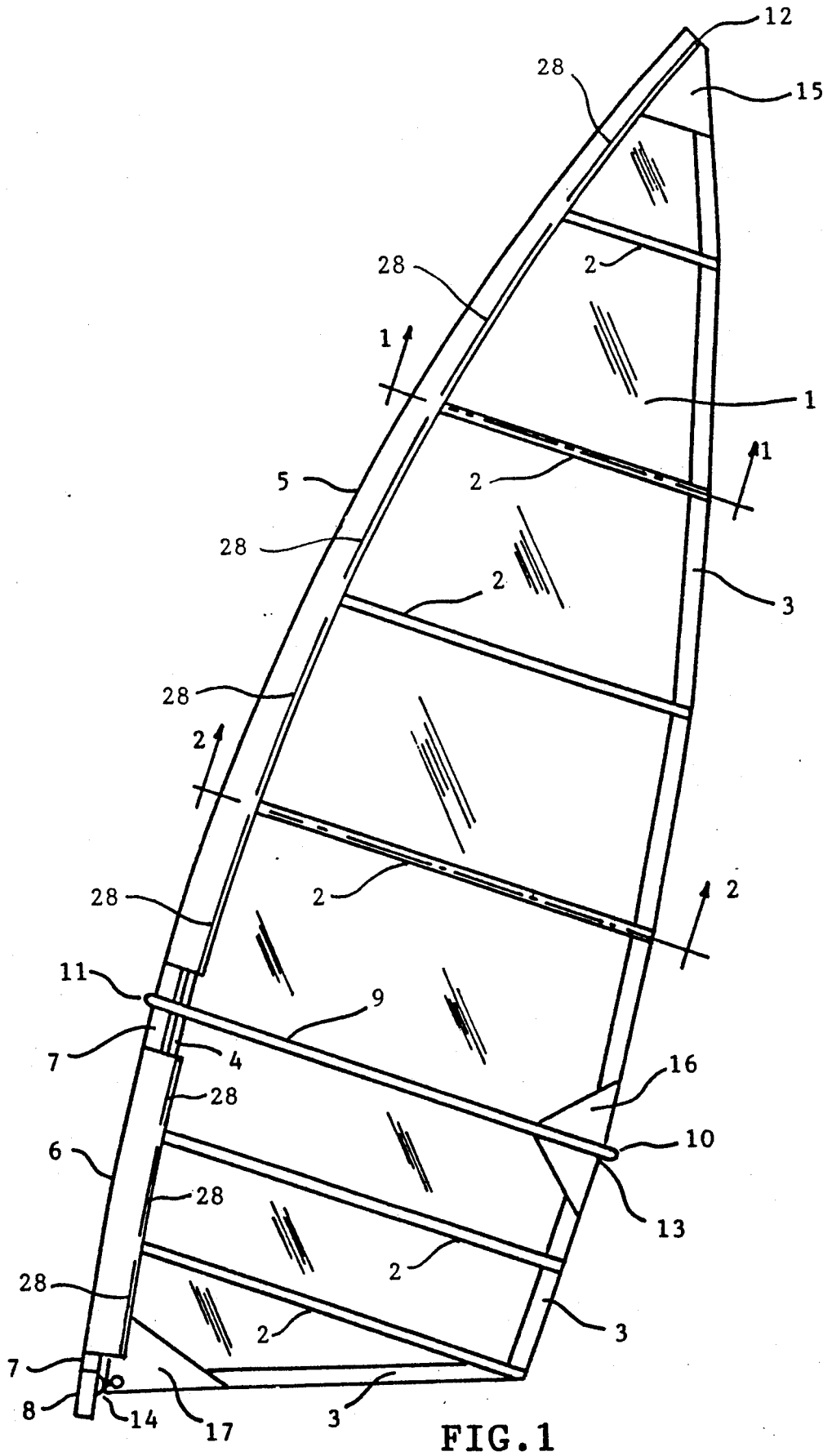
FIG. 1 is a plan view of a single surface sail rig structure.

In FIG. 1 is shown a plan view of a sail rig consisting of pre-cut Mylar sail material 1, rib assembly 2 which is a permanent member of the sail structure, trailing edge adhesive fabric material strip 3, leading edge adhesive fabric material strip 4, and an upper sail leading edge luff sleeve 5 and lower leading edge luff sleeve 6 that is connected to sail material 1 by sew stitches 28 (shown by a line).

The static loads in the sail material 1 are caused by the pre-tension force from rib assemblies 2, and the flexure resistance force of the mast 7 caused by rigging the sail to the mast 7 and the boom 9. The sail structure, when rigged, is supported mainly at the sail head 12, the sail clew 13, and the sail tack 14. The sail head 12 consists of an adhesive fabric section 15 that is sewed to sail material 1, leading edge adhesive fabric strip material 4, and trailing edge adhesive fabric strip material 3. Adhesive fabric section 15 is made of a high strength material and serves to reduce the stress in the head region of the sail structure. The clew 13 consists of adhesive fabric section 16 that is sewed to sail material 1 and trailing edge adhesive fabric strip material 3. Adhesive fabric section 16 is made of a high strength material with a grommet (not shown) fixed thereto for attachment of the boom end 10 and serves to reduce the stress in the clew region of the sail structure. The sail tack 14 consists of adhesive fabric section 17 that is sewed to the leading edge adhesive fabric strip 4, sail material 1, and trailing edge adhesive fabric strip material 3. Adhesive fabric section 17 is made of a high strength material with a grommet fixed thereto for attachment to mast base 8 and serves to reduce the stress in the tack region of the sail structure. Boom end 11 is fixed to mast 7 by one of many mechanical attachment means that are available in the windsurfing industry.

Figure 2:
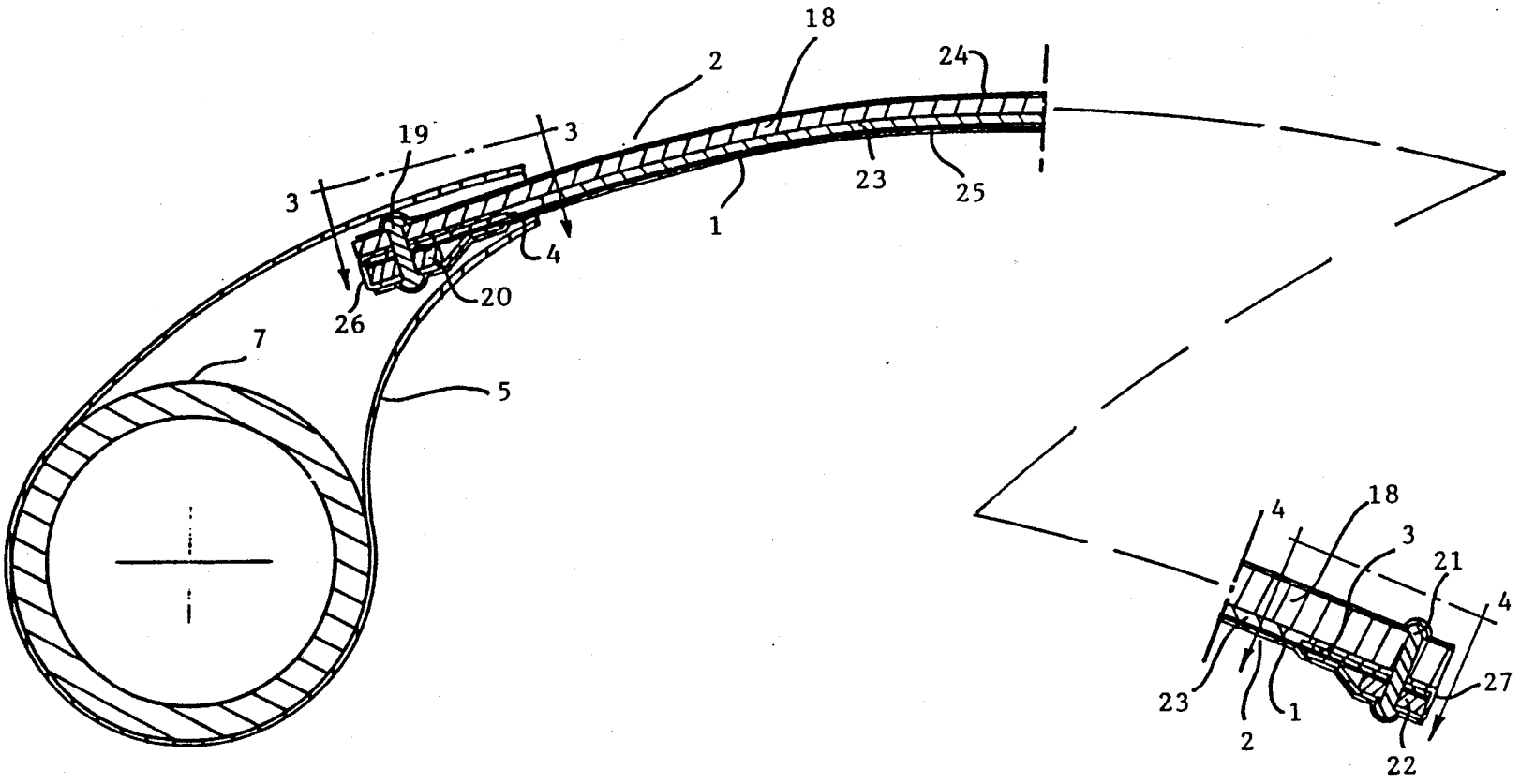
FIG. 2 is a sectional view through line 1—1 of the sail rig structure shown in FIG. 1.
Figure 4:
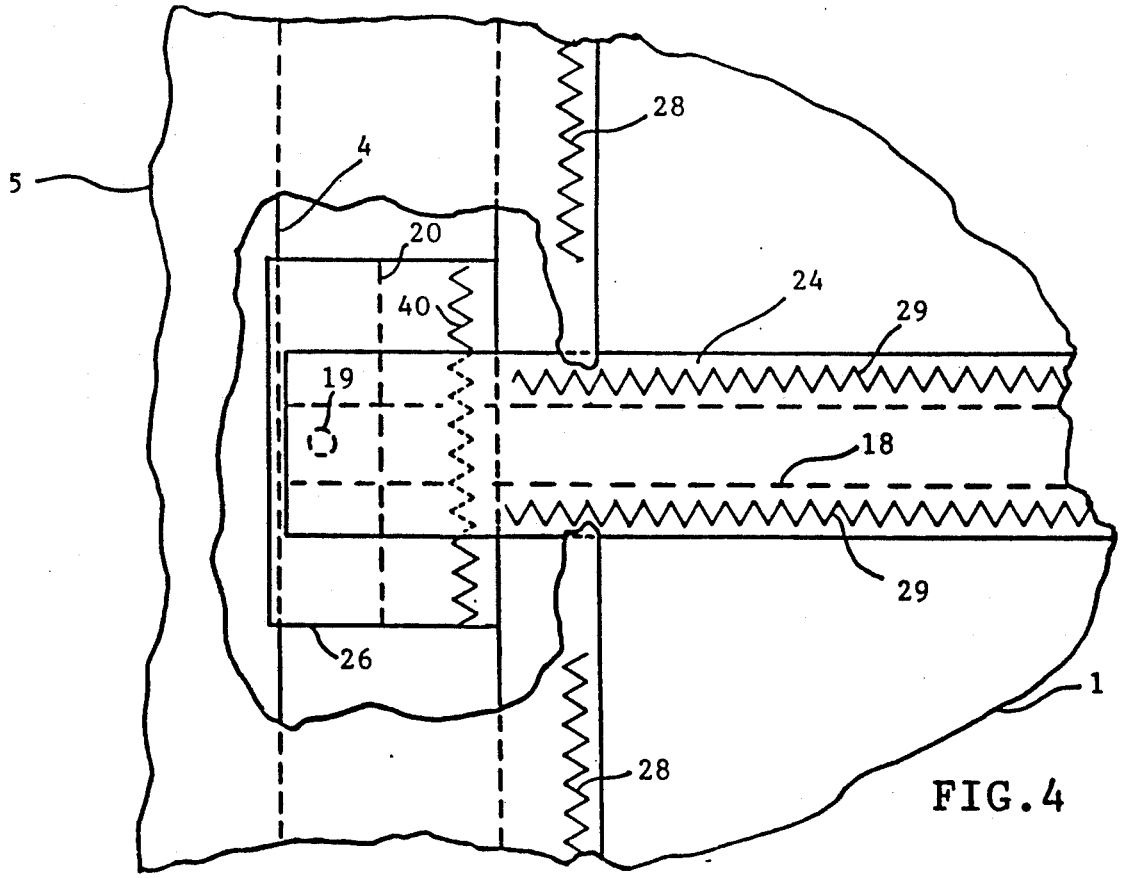
FIG. 4 is a fragmentary view taken along line 3—3 of FIG. 2 showing the rib attachment to the leading edge of the main sail structure.
Figure 5:
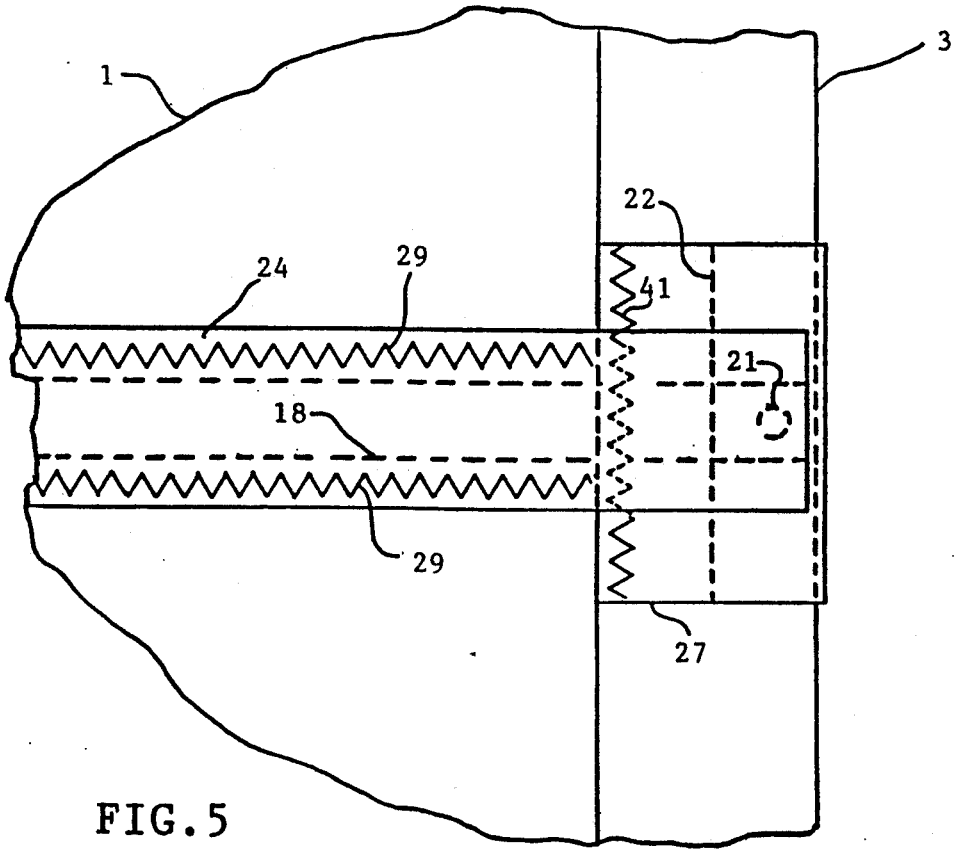
FIG. 5 is a fragmentary view take along line 4—4 of FIG. 2 showing the rib attachment to the trailing edge of the main sail structure.

FIG. 2 shows a free luff sail structure from a view along lines 1—1 of FIG. 1. It consists of a rib assembly 2 which is fixed to sail material 1, leading edge adhesive fabric material strip 4, and trailing edge adhesive material strip 3. Rib assembly 2 consists of a rib 18 that has pre-stretched sail material 1 and is fixed to the forward edge of the sail by rivet 19 and plate 20 and fixed to the rearward edge of the sail by rivet 21 and plate 22. The airfoil shape of the free luff sail structure is established when the sail is operated in true wind velocities that the sail was designed for. The airfoil shape of the sail is controlled by the flexure resistance distribution of the rib 18, the width of the luff sleeve 5, and the space between the the rearward outer surface of the mast 7 and the forward edge of the sail structure. The rib 18 is attached to the sail material 1 by adhesive 23, and adhesive fabric strip material 24 and 25. Said adhesive fabric strip material 24 and 25 is sewed to sail material 1 as shown in FIG. 4 and FIG. 5. The plate 20 is fixed to the forward edge of the sail material 1 by adhesive fabric strip 26 which is sewed to sail material 1 and leading edge adhesive fabric strip 4 as shown in FIG. 4. Plate 22 is fixed to the rearward edge of the sail material 1 by adhesive fabric strip 27 which is sewed to sail material 1 and trailing edge adhesive fabric strip 3 as shown in FIG. 5.

Figure 3:
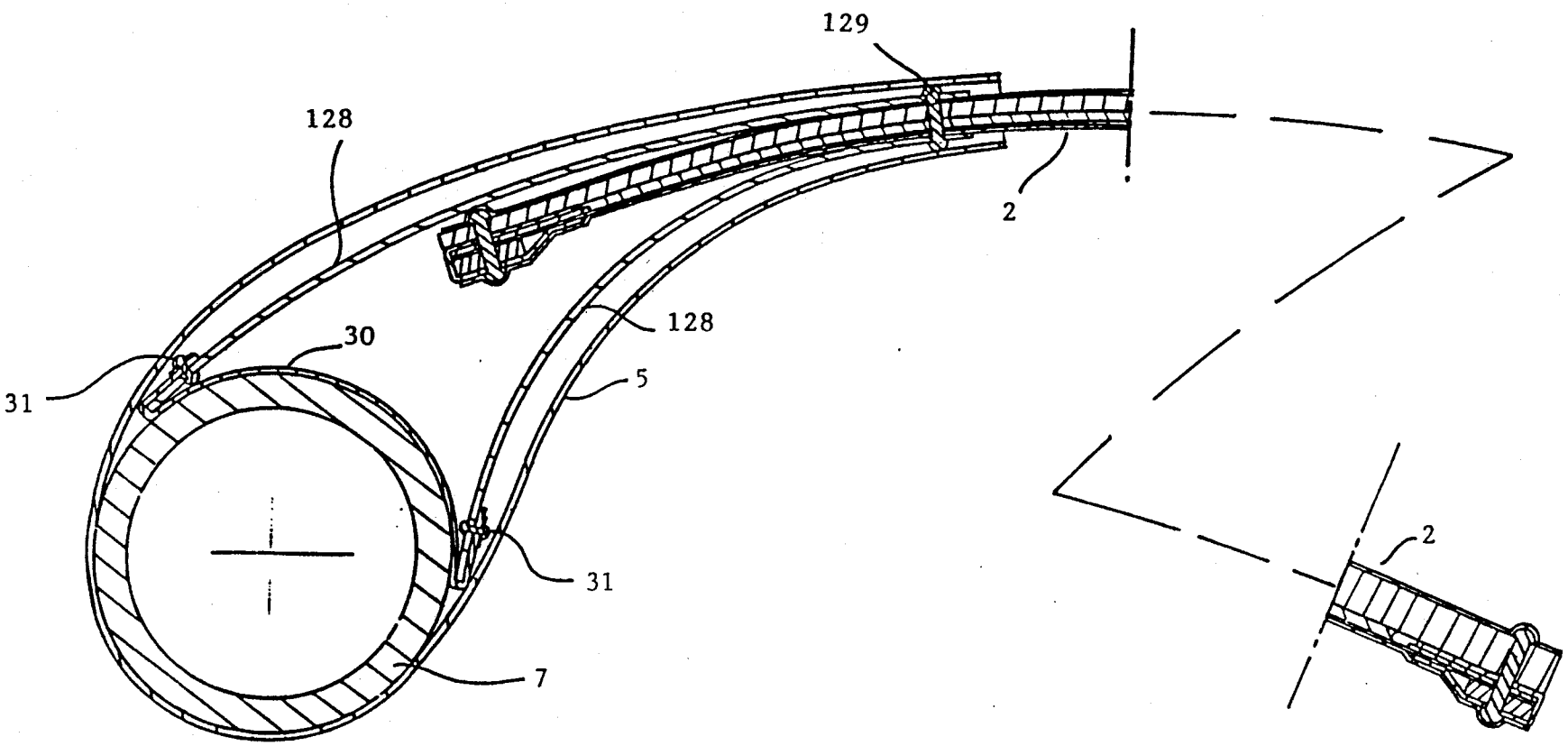
FIG. 3 is a sectional view through line 2—2 of the sail rig structure shown in FIG. 1.

FIG. 3 shows a sail structure from a view along lines 2—2 of FIG. 1. In this structure, rib extenders 128 are fixed to the rib assembly 2 with rivet 129. Flexible member 30 is fixed to the forward ends of the rib extenders 128 with rivets 31. The width of rib extenders 128 and flexible member 30 is equal to the width of rib 18 shown in FIG. 4. Flexible member 30 makes slidable contact with mast 7 allowing an airfoil shape to be induced into the forward end of the sail. The flexure resistance of rib extenders 128 is selected to control the amount of curvature desired in the forward end of the sail. In this configuration, the airfoil shape of the sail does not depend on aerodynamic loading. The advantage gained here is that the sail can be operated efficiently in light wind conditions where the aerodynamic loading is insufficient to induce an airfoil shape in the sail as provided in the free luff configuration of FIG. 2 operating at design true wind velocities. Typically, a sail designed for pure speed may not incorporate the rib extender features shown in FIG. 3 because acceleration is not a requirement in speed sailing. However, where acceleration is a requirement such as in course racing events where stop-and-go type of sailing prevails at the turning marks of the race course, the sail designed for course racing may incorporate the features shown in FIG. 3 in all the ribs located in the mid to bottom portion of the sail.

FIG. 4 is a view along line 3—3 of FIG. 2 showing attachment of rib 18 to the forward edge of the sail structure and attachment of luff sleeve 5 to sail material 1 by sew stitch 28 and attachment of adhesive fabric strip material 24, and 25 (not shown) to sail material 1 by sew stitch 29. Adhesive fabric strip 26 secures plate 20 to the forward edge of sail material 1 and leading edge adhesive fabric strip 4 by sew stitch 40. This assures that the stress generated by the pre-tensioned rib 18 in the sail material 1 and leading edge adhesive fabric strip 4 is reduced along the region of sew stitch 40. This eliminates high stress concentration in the sail if the rivet 19 alone was to carry the rib tension force into the sail.

FIG. 5 is a view along line 4—4 of FIG. 2 showing attachment of rib 18 to the rearward edge of the sail structure and the attachment of adhesive fabric strip material 24 and 25 (not shown) to sail material 1 by sew stitches 29. Adhesive fabric strip material 27 secures plate 22 to the rearward edge of sail material 1 and trailing edge adhesive fabric strip 3 by sew stitch 41. This assures that the stress generated by the pre-tensioned rib 18 in the sail material 1 and trailing edge adhesive fabric strip 3 is reduced along the region of sew stitch 41. This eliminates high stress concentration in sail if the rivet 21 alone was to carry the rib tension force into the sail.

Figure 6:
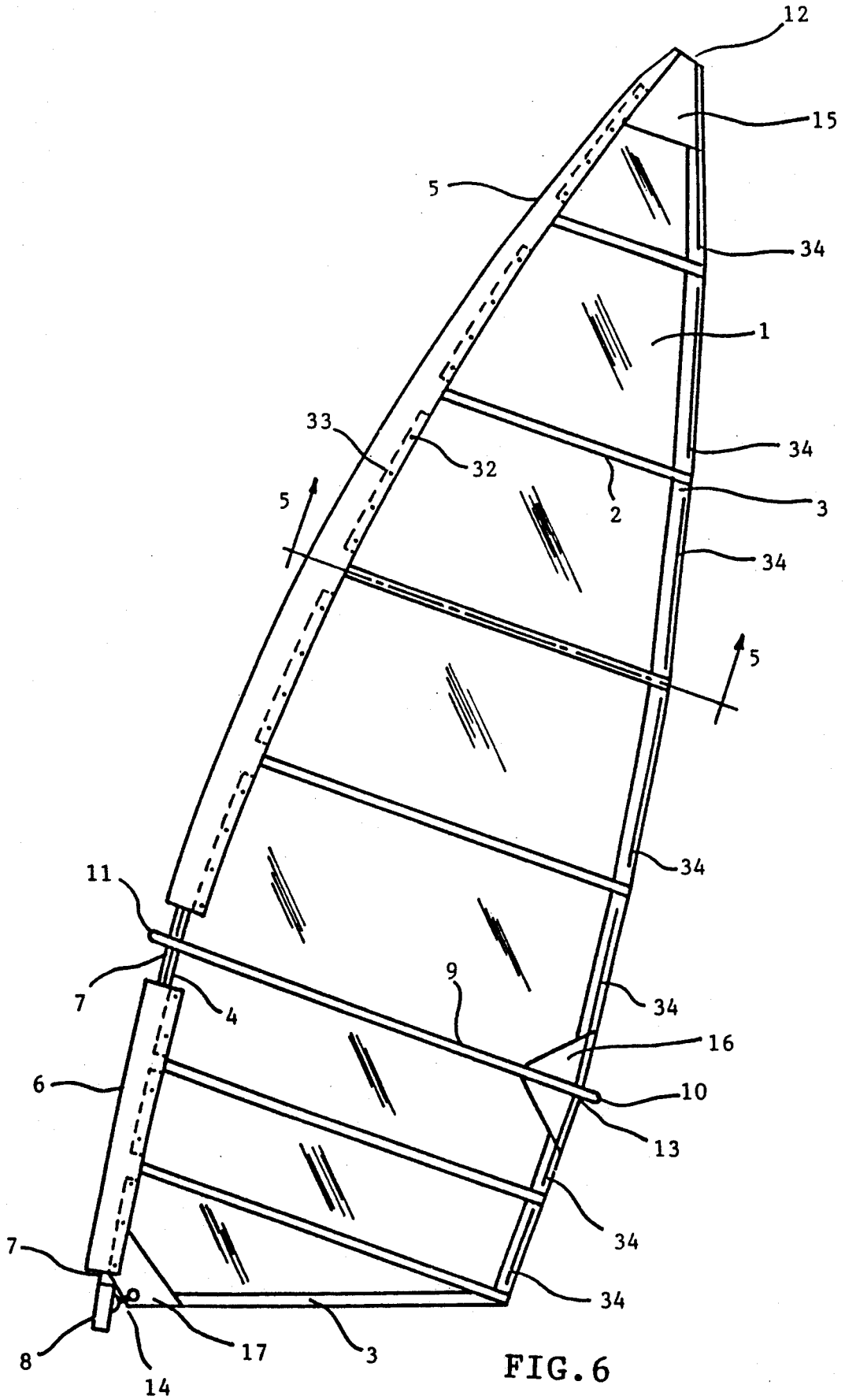
FIG. 6 is a plan view of a double surface sail rig structure.

In FIG. 6 is shown a plan view of a double surface sail rig structure utilizing the construction for each sail surface previously described in FIG. 1. Luff sleeve 5 is attached to the forward section of each sail surface with rivets 32 and a high strength adhesive fabric tape 33. Said high strength adhesive fabric tape 33 is applied to both sides of each of the sail surfaces 1. Said high strength adhesive fabric tape 33 may also be applied to both sides of the edge of luff sleeve 5 and sewed thereto. The use of a high strength adhesive fabric tape assures against tearing of luff sleeve material 5 and sail material 1 by the rivets 32. The trailing edge of each of the sail surfaces is connected by sew stitches 34 (shown by a line).

Figure 7:
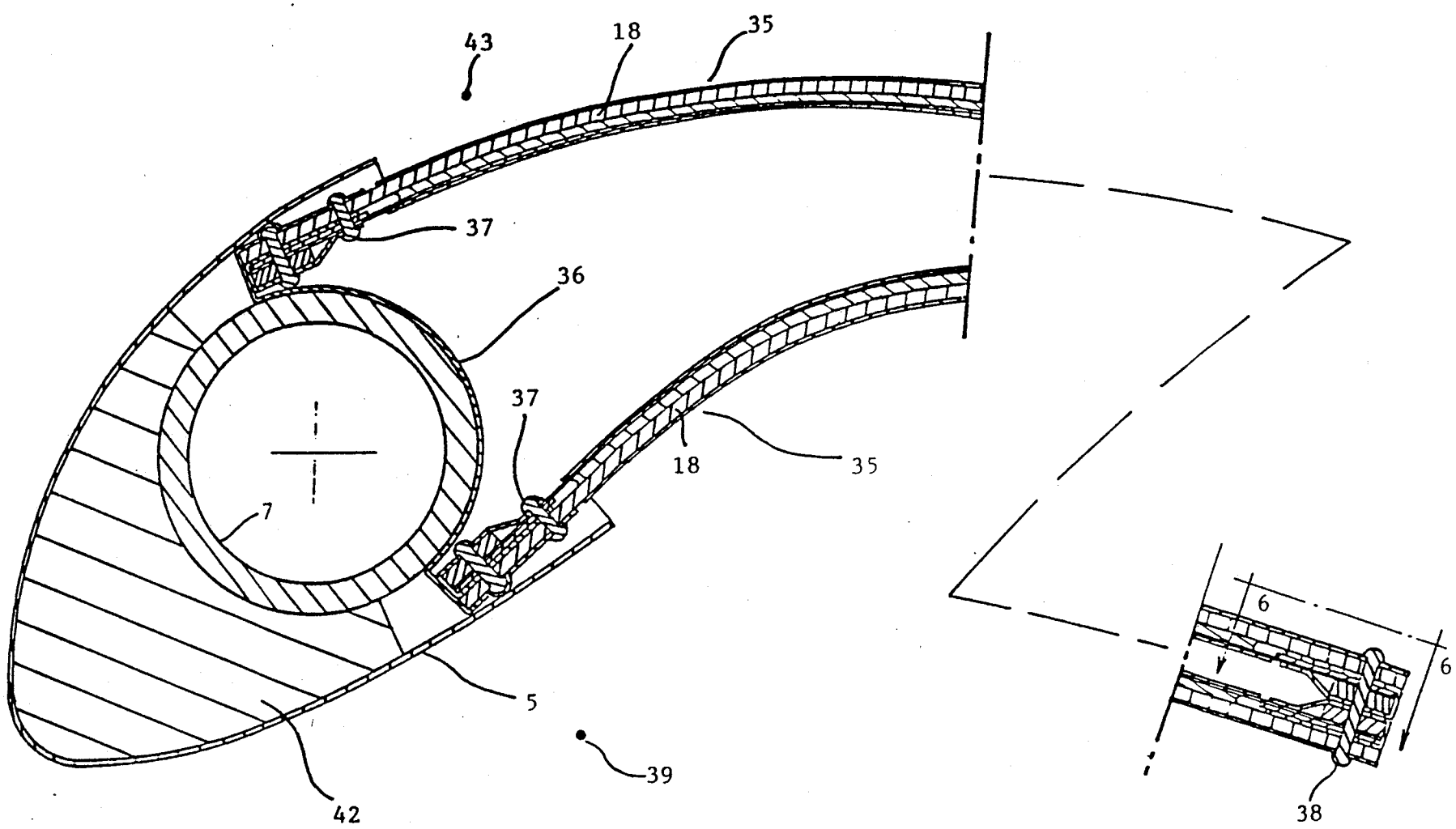
FIG. 7 is a sectional view through line 5—5 of the sail rig structure shown in FIG. 6.

In FIG. 7 is shown a view through line 5—5 of the double surface sail rig structure shown in FIG. 6. This sail structure consists mainly of two sail surfaces 35 that are connected at their forward end by flexible member 36 with rivets 37 through ribs 18, and connected at their rearward end with rivets 38. A parbolic formed leading edge structure consists of a flexible leading edge member 42 which is fixed to the mast 7 with an adhesive and makes slidable contact with luff sleeve 5. Luff sleeve 5 is fixed to the sail surfaces between ribs with rivets 32 shown in FIG. 6. Mast 7 makes slidable contact with flexible member 36. Said flexible member 36 has a width equal to the width of the rib 18 shown in FIG. 4.

The double surface sail rig provides a significant improvement in aerodynamic flow over that of the single surface sail rig when operating in true wind speeds greater than 35 knots. This improved aerodynamic flow results from the smooth entry of the air flow in the forward windward region 39 and the forward leeward region 43 shown in FIG. 7. The smooth entry assures a non-separated air flow over the entire windward and leeward surfaces of the sail, thereby eliminating drag forces in the sail that are caused by separated air flow.

Figure 8:
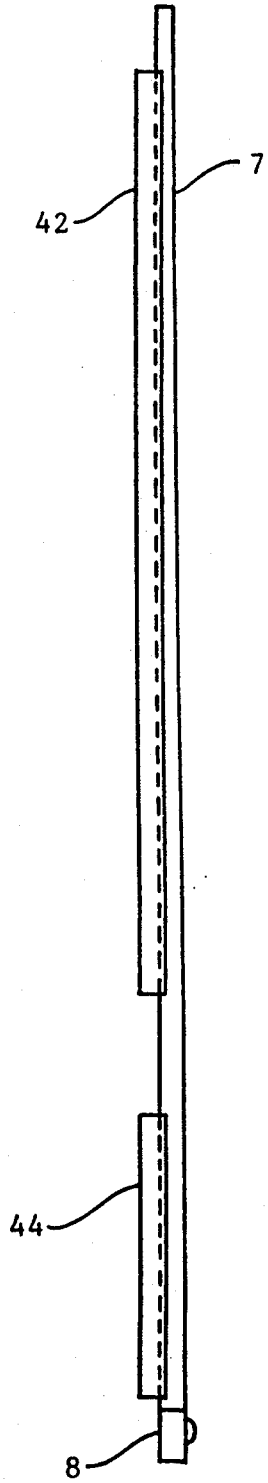
FIG. 8 is a plan view of the mast assembly used in the double surface sail rig structure shown in FIG. 7.

In FIG. 8 is shown a plan view of the mast assembly used in the double surface sail rig structure shown in FIG. 7. The mast assembly consists of an upper flexible leading edge member 42 fixed to mast 7 with an adhesive and a lower flexible leading edge member 44 fixed to mast 7 with an adhesive. This mast assembly can also be used in a single surface sail rig structure to provide aerodynamic flow improvements that will reduce drag forces in the sail.

Figure 9:
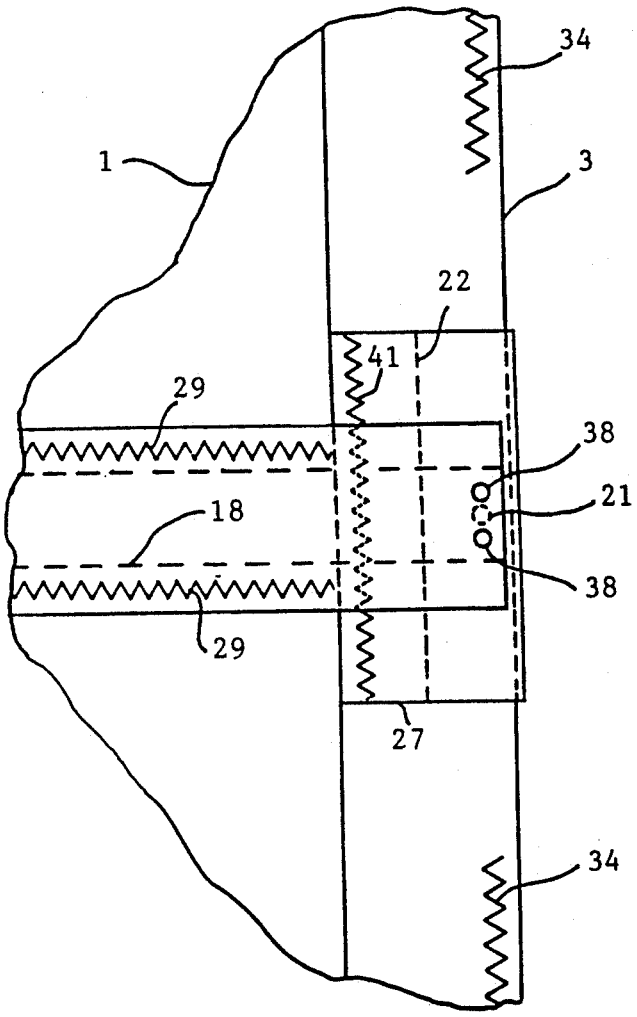
FIG. 9 is a fragmentary view taken along line 6—6 of FIG. 7 showing the trailing edge attachment of the double sail surfaces.

In FIG. 9 is shown a fragmentary view through line 6—6 of FIG. 7 showing the trailing edge attachment of the double sail surfaces. Rivets 38 fix the trailing edges of the two sail surfaces at the rib 18 location and sew stitch 34 fixes the remaining trailing edges of the two sail surfaces as shown in FIG. 6.

Figure 10:
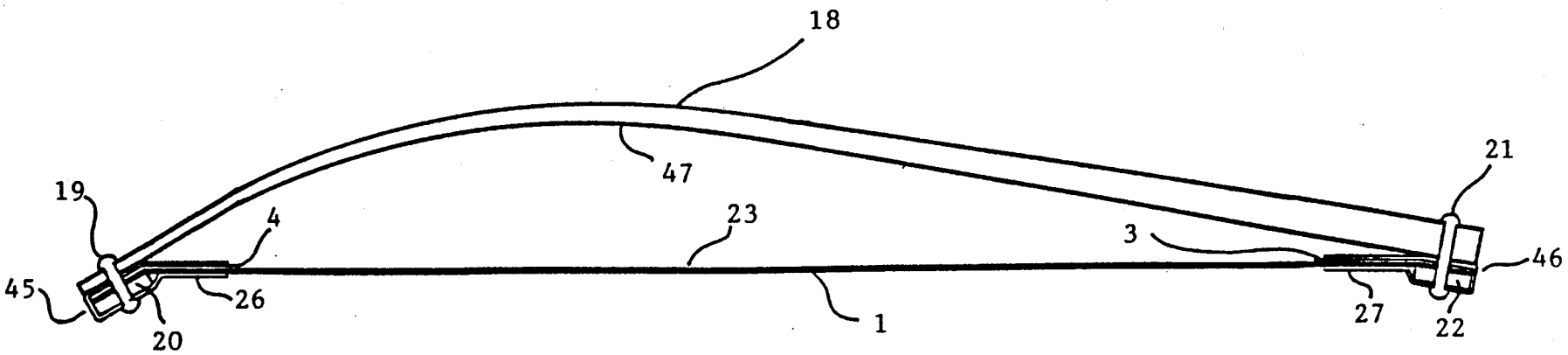
FIG. 10 shows the preferred method used to prestretch the sail material onto the full length of a rib.

In FIG. 10 is shown the preferred method used to pre-stretch pre-cut sail material 1 prior to final attachment to rib 18. The forward end of the rib 18 is first attached to the front end 45 of the sail material 1 and leading edge adhesive fabric strip 4 by rivet 19 and plate 20 attachment. The rib 18 is then flexed as shown to line up its rearward end with the rear end 46 of the sail material 1 and trailing edge adhesive fabric strip 3. The rear end of the rib is then secured to the sail material 1 and trailing edge adhesive fabric strip 3 by rivet 21 and plate 22 attachment. The rib 18 is then forced in the direction of said sail material 1 to an overcenter position, not shown, causing stretching of sail material 1 and making final attachment along the length of the bottom of rib 18 by use of a pre-affixed adhesive 23 between the rib surface 47 and sail material 1 being forced together. The space between the forward and rearward rivet mounting holes in rib 18 is made larger than the space between the forward and rearward rivet mounting holes in plate 20 and plate 22 so that the sail material 1 is stretched. The amount of stretch is determined from an analysis of the physical properties data provided by the sail materials manufacture and an analysis which determines the average stress in the sail in the region between the sail tack and sail clew, sail clew and sail head, and sail tack and sail head. The stress-strain data of the polyester film material 1 is utilized to assure that the pre-stretched rib induced stress levels in the sail are within the elastic limits of the sail material. The final assembly is shown in FIGS. 2, 3, 4, and 5.

Figure 11:
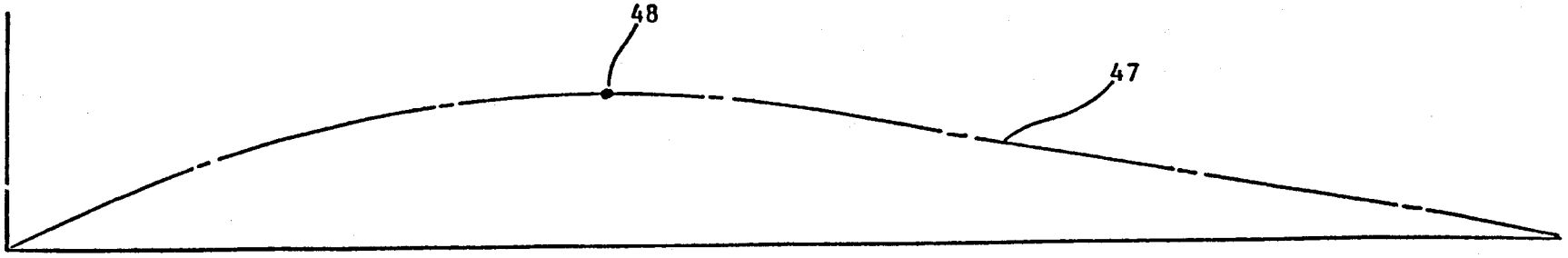
FIG. 11 shows the typical center line curvature of a commercially available foam-filled batten when flexed.

In FIG. 11 is shown the typical center line curvature 47 of a commercially available constant tapered foam-filled batten when flexed. The point of maximum curvature 48 or draft is located approximately 35 to 40 percent of the center line length of the batten.

Figure 12:
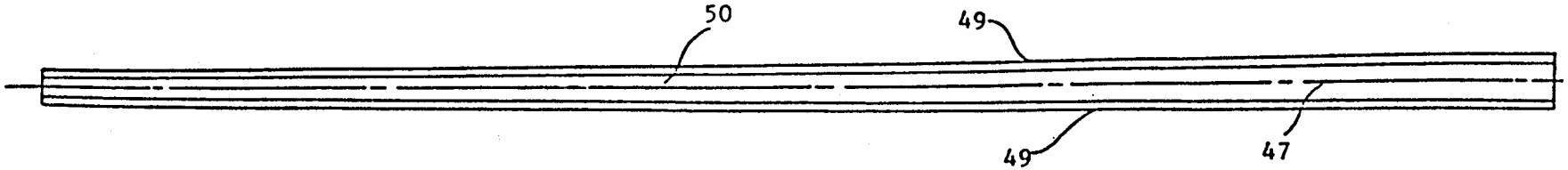
FIG. 12 is a side view of a commercially available foam-filled batten.

In FIG. 12 is shown a side view of a commercially available constant tapered foam-filled batten consisting of uni-directional epoxy glass fiber strips 49 which are bonded to close cell foam spacer 50.

Figure 13:
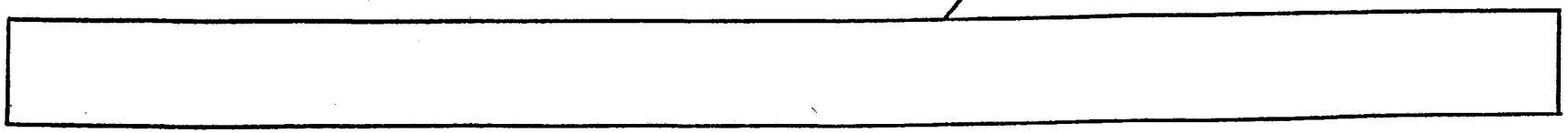
FIG. 13 is a plan view of a commercially available foam-filled batten.

In FIG. 13 is shown a plan view of the commercially available constant tapered foam-filled batten shown in FIG. 12.

In the batten shown in FIG. 12 and FIG. 13, the thickness of the uni-directional epoxy glass fiber strips 49 is constant whereby the close cell foam spacer 50 has a varying thickness of constant taper. This construction provides for a light weight batten that is easy to manufacture, however it has a disadvantage in that it places the draft point 48 shown in FIG. 11 too far back from the forward edge of the sail. In addition to having the draft too far back in the sail, the flexure resistance of this type of batten is insufficient in keeping the draft point 48 shown in FIG. 11 from moving to the rear of the sail during high speed sailing where the aerodynamic loading in the sail is greatest.

Figure 14:
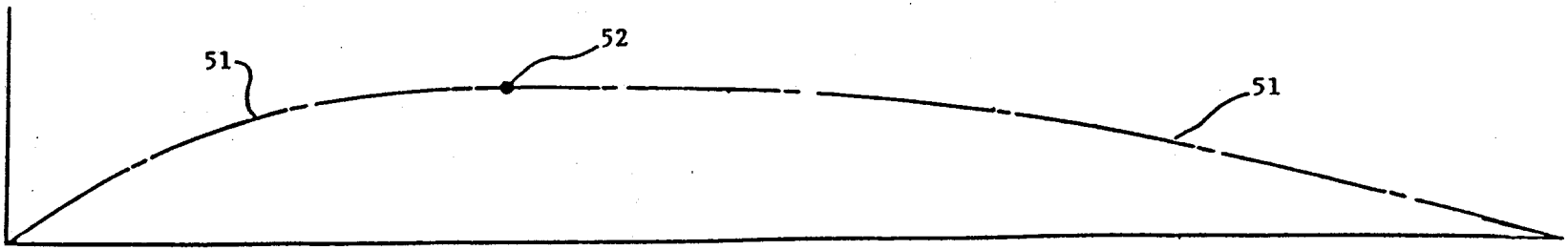
FIG. 14 shows an improved center line curvature of a modified commercially available foam-filled batten when flexed and to be used as a rib in this invention.

In FIG. 14 is shown an improved center line curvature 51 of a modified commercially available constant tapered foam-filled batten that is to be used as a rib in this invention. The point of maximum curvature 52 or draft of the rib is located approximately 25 to 29 percent of the center line length of the rib.

Figure 15:
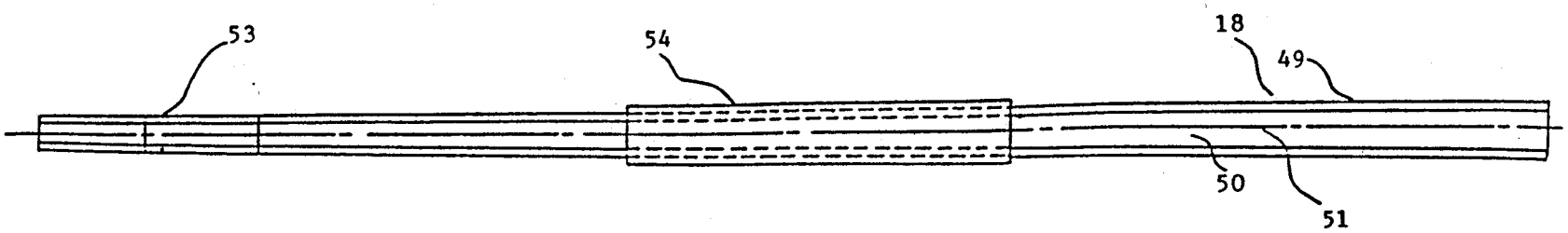
FIG. 15 is a side view of a modified commercially available foam-filled batten to be used as a rib in this invention.

In FIG. 15 is shown a side view of a modified commercially available constant tapered foam-filled batten to be used as a rib 18 in this invention consisting of a reduced flexure resistance forward section 53 and an increased flexure resistance mid section 54.

Figure 16:
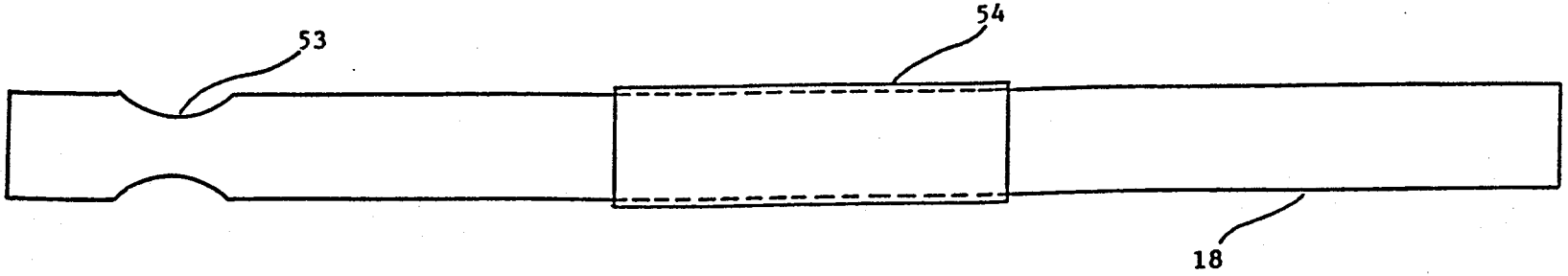
FIG. 16 is a plan view of a modified commercially available foam-filled batten to be used as a rib in this invention.

In FIG. 16 is shown a plan view of a rib 18 shown in FIG. 15.

In the rib 18 shown in FIG. 15 and FIG. 16, said reduced flexure resistance forward section 53 is obtained by reducing the cross sectional area of the rib as shown. Said increased flexure resistance mid section 54 consists of uni-directional epoxy carbon fiber material bonded to said rib 18 as shown. Said reduced flexure resistance forward section 53 provides for more forward curvature in the rib whereby said increased flexure resistance midsection 54 assures less curvature in the mid to rear section of the rib. This rib configuration provides an efficient forward draft airfoil shape in the sail surface at all operating sailing speeds and particularly during high speed sailing where the aerodynamic loading in the sail is greatest. In the upper region of the sail where the aerodynamic loading is less than the loading in the mid to lower region of the sail, the modification in the batten shown in FIG. 12 and FIG. 13 may require only a reduction in the flexure resistance in the forward section as shown in FIGS. 15 and 16 item 53. An improvement in the batten shown in FIGS. 12 and 13 may require only the application of uni-directional epoxy carbon fiber material as shown in FIGS. 15 and 16 item 54 which provides for a more forward draft rib with less forward curvature.

While the principles of the invention have now been made clear in the illustrative embodiment, it will become obvious to those skilled in the art that many modifications in arrangement are possible without departing from those principles. The appended claims are, therefore, intended to cover and embrace any such modifications, within the limits of the true spirit and scope of the invention.

I claim:

1. A sail having sail material with a leading edge and trailing edge, a rib having a front end and rear end, first holding means fixed adjacent the leading edge to hold the front end of the rib, second holding means fixed adjacent the trailing edge to hold the rear end of the rib, said front end of the rib being held by said first holding means against forward movement, said rear end of the rib being held by said second holding means against rearward movement, said rib being under compression between said first holding means and said second holding means stretching said sail, said rib being adhered to said sail.

2. A sail as set forth in claim 1 wherein said first holding means is a rivet and first plate means, and said second holding means is a rivet and second plate means.

3. A sail as set forth in claim 1 wherein said rib is adhered to said sail along its length where it contacts said sail.

4. A sail as set forth in claim 1 wherein a first supporting material strip is fixed along the leading edge of the sail, a second supporting material strip is fixed along the trailing edge of the sail; said first holding means fixing said sail material, and said first supporting material strip and rib together; said second holding means fixing said sail material, said second supporting material strip and rib together.

5. A sail as set forth in claim 4 wherein first plate means is secured to said first supporting material strip and said sail by a fabric strip that extends along the full length of said first plate and encompassing said first plate, said first supporting material strip and said sail fixed thereto by a sew stitch and wherein second plate means is secured to said second supporting material strip and said sail by a fabric strip that extends along the full length of said second plate and encompassing said second plate, said second supporting material strip and said sail fixed thereto by a sew stitch.

6. A sail as set forth in claim 1 including a first extending member with a forward end and rearward end, a second extending member with a forward end and rearward end, said rearward end of said first extending member being fixed to the forward end of one side of said rib and said sail, said second extending member rearward end being fixed to the opposite side of said rib and said sail, and in line with the rearward end of said first extending member, the forward end of said first extending member fixed to one end of a flexible connecting member and the forward end of said second extending member fixed to the opposite end of said flexible connecting member, said flexible connecting member making slidable contact with a mast.

7. A sail as set forth in claim 6 wherein the forward ends of said first extending member and said second extending member are fixed to the ends of said flexible connecting member by a rivet and washer means and wherein the rearward ends of said first extending member and said second extending member are fixed to the forward end of said sail and said rib by a rivet means.

8. A sail as set forth in claim 6 wherein each of the ribs located from the upper mid span of said sail to the bottom of said sail incorporates said first and second extending member.

9. A sail a set forth in claim 1 wherein a first adhesive fabric strip is fixed along the length of said rib facing away from said sail material, and fixed along adjacent sail material, a second adhesive fabric strip is fixed along said sail material facing away from said rib along the length of said rib, and said first adhesive fabric strip and said second adhesive fabric strip being fixed to each other and to said sail material along each side of the rib.

10. A sail having a leading edge at its front and a trailing edge at its rear with a desired three-dimensional shape when mounted on a mast, said sail having sail material and ribs, said sail material being pre-stretched between forward and rearward ends and adhered to a plurality of ribs extending from the forward end of the sail material to the rearward end of the sail material, each of said ribs being adhered to said sail material to maintain a desired curvature to the sail material forming the sail.

11. A sail as set forth in claim 10 including each of said ribs having a forward end and a rearward end, forward fixing means fixing the forward end of each of said ribs to the forward end of said sail material, rearward fixing means fixing the rearward end of each of said ribs to the rearward end of said sail material, each of said ribs being placed in compression and biased to one side or the other between its cooperating forward fixing means and rearward fixing means.

12. A sail as set forth in claim 11 including a leading edge luff sleeve for receiving a mast, means connecting said luff sleeve to the forward end of said sail material.

13. A sail construction having a double sail surface comprising a first sail having a forward end at its front and a rearward end at its rear with a desired three-dimensional shape when mounted on a mast, a second sail having a forward end at its front and a rearward end at its rear with a desired three-dimensional shape when mounted on a mast, said first and second sails having sail material and ribs, said sail material being pre-stretched between forward and rearward ends and adhered to a plurality of ribs extending from the forward end of the sail material to the rearward end of the sail material, each of said ribs being adhered to said sail material to maintain a desired curvature to the sail material forming the first sail and second sail, a mast, flexible means connecting each of said first and second sails having slidable contact with said mast, the forward edge of each first and second sail being connected to opposite sides of said flexible means, the rearward ends of said first and second sails being connected.

14. A sail construction as set forth in claim 13 including an upper and lower flexible leading edge member which is adhered to said mast and making slidable contact with an upper and lower luff sleeve, wherein one edge of said upper and lower luff sleeve is fixed to the forward edge of said first sail and the other edge of said upper and lower luff sleeve being fixed to the forward edge of said second sail.

15. A method of affixing a rib to a sail at a location between the (1) leading edge of the sail, and (2) trailing edge of the sail, wherein the space between the fixing points of the sail is less than the space between the fixing points of the rib:

(1) place the sail surface on a flat supporting surface;
(2) locate the position on the sail between the leading edge of the sail and the trailing edge of the sail where a rib is desired;
(3) affix the forward end of the rib to the leading edge of the sail;
(4) bend the rib away from the sail surface to place the rear end of the rib at the trailing edge of the sail;
(5) affix the rear end of the rib to the trailing edge of the sail;
(6) apply an adhesive material to the sail surface facing the rib or apply an adhesive material to the rib facing the sail surface;
(7) bend the rib towards the sail surface stretching the sail to an overcenter position of the rib where the rib flexes in a direction towards the sail and it is forced against the sail stretching it within elastic limits and applying a force for adhering them together permanently;
(8) apply a first adhesive fabric strip material along the length of the rib facing away from the sail to the rib surface and sail surface and apply a second adhesive fabric strip material along the sail facing away from the rib, sewing said first adhesive fabric strip material and said second adhesive fabric strip material to the sail along both sides of the rib.

16. A sail having sail material with a leading edge and trailing edge, ribs having a front end and rear end, a rivet and first plate means fixed adjacent said leading edge to secure the front end of each rib preventing forward and rearward motion of each rib relative to said leading edge, a rivet and second plate means fixed adjacent said trailing edge to secure the rear end of each rib preventing forward and rearward motion of each rib relative to said trailing edge, each rib being under compression between said rivet and said first plate means and said rivet and said second plate means stretching said sail, and means fixedly holding said ribs to the sail along its length where it contacts said sail.

17. A sail as set forth in claim 16 including a leading edge luff sleeve for receiving a mast, means connecting said luff sleeve to the forward end of said sail material.

18. A sail as set forth in claim 16 including a first extending member with a forward end and a rearward end, a second extending member with a forward end and a rearward end, said rearward end of said first extending member being fixed to the forward end of one side of said rib and said sail, said rearward end of said second extending member being fixed to the forward end of the opposite side of said rib and said sail, a flexible connecting member for making slidably contact with a mast, the forward end of said first extending member being fixed to one end of said flexible connecting member, and the forward end of said second extending member being fixed to the opposite end of said flexible connecting member.

19. A sail as set forth in claim 18 wherein the forward ends of said first extending member and said second extending member are fixed to the ends of said flexible connecting member by a rivet means and wherein the rearward ends of said first extending member and said second extending member are fixed to the forward end of said sail and rib by a rivet means.

20. A sail construction having a double sail surface comprising a first sail having a forward end at its front and a rearward end at its rear, a second sail having a forward end at its front and a rearward end at its rear, said first and second sails each having sail material with a leading edge and trailing edge, ribs for said first sail and second sail having a front end and rear end, a rivet and first plate means fixed adjacent each leading edge to secure the front end of each rib preventing forward and rearward motion of each rib relative to said leading edge, a rivet and second plate means fixed adjacent each trailing edge to secure the rear end of each rib preventing forward and rearward motion of each rib relative to said railing edge, each rib being under compression between its rivet and first plate means and its rivet and second plate means stretching said sail, means fixedly holding said ribs to the sail along its length where it contacts said sail, a mast, flexible members connecting each of said first and second sails having slidable contact with said mast, the forward edge of each of said first and said second sails being connected to the opposite sides of said flexible members, the rearward ends of said first and said second sails being connected, an upper and lower flexible leading edge member is adhered to said mast, an upper and lower luff sleeve, wherein one edge of said upper and lower luff sleeve is fixed to the forward edge of said first sail and the other edge of said upper and lower luff sleeve being fixed to the forward edge of said second sail, said upper and lower luff sleeves having slidable contact with said upper and lower flexible leading edge members.

21. A sail having a leading edge at its front and a trailing edge at its rear, said sail having said material and ribs, said sail material being pre-stretched between forward and rearward ends and adhered to a plurality of ribs extending from the forward end of the sail material to the rearward end of the sail material preventing relative motion between said ribs and said sail material.

22. A sail as set forth in claim 21 including a leading edge luff sleeve for receiving a mast, means connecting said luff sleeve to the forward end of said sail material.

23. A sail construction having a double sail surface comprising a first sail having a forward end at its front and a rearward end at its rear, a second sail having a forward end at its front and a rearward end at its rear, said first and second sails having a leading edge at its front and a trailing edge at its rear, said first and second sails having sail material and ribs, said sail material being pre-stretched between forward and rearward ends and adhered to a plurality of ribs extending from the forward end of the sail material to the rearward end of the sail material preventing relative motion between said ribs and said sail material, a mast, flexible members connect each of said first and said second sails and have slidable contact with the mast, the forward edge of each of said first and said second sails being connected to the opposite sides of said flexible members, the rearward ends of said first and said second sails being connected, an upper and lower flexible leading edge member is adhered to said mast for making slidable contact with an upper and lower luff sleeve, one edge of an upper and lower luff sleeve is fixed to the forward end of said first sail and the other edge of an upper and lower luff sleeve is fixed to the forward end of said second sail.

24. A sail having a sail material with a leading edge and trailing edge, ribs having a front end and rear end, first holding means fixedly holding the front end of each rib to the leading edge of the sail material, second holding means fixedly holding the rear end of each rib to the trailing edge of the sail material, each of said ribs being under compression between said first holding means and said second holding means, means fixedly holding said ribs to said sail material along its length where it contacts said sail material.

25. A sail as set forth in claim 24 including a leading edge luff sleeve for receiving a mast, means connecting said luff sleeve to the forward end of said sail material.

26. A sail as set forth in claim 24 wherein said means fixedly holding said ribs to said sail material includes a plurality of said ribs and said sail material being adhered to each other along the length of the ribs.

* * * * *